US010910760B1

(12) United States Patent
Yang et al.

(10) Patent No.: US 10,910,760 B1
(45) Date of Patent: Feb. 2, 2021

(54) MODULAR CONNECTOR WITH A ROTATABLE LOCKING PART FOR ENGAGING WITH A MATING MODULAR CONNECTOR

(71) Applicant: Wistron Corporation, New Taipei (TW)

(72) Inventors: Yifang Yang, New Taipei (TW); Chaodong Liu, New Taipei (TW); Yu He, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/733,205

(22) Filed: Jan. 2, 2020

(30) Foreign Application Priority Data

Sep. 11, 2019 (CN) ..... 2019 2 1513403 U

(51) Int. Cl.

| | |
|---|---|
| ***H01R 13/639*** | (2006.01) |
| ***H01R 13/514*** | (2006.01) |
| ***H01R 4/245*** | (2018.01) |
| ***H01R 13/627*** | (2006.01) |
| ***H01R 13/518*** | (2006.01) |
| *H01R 13/62* | (2006.01) |
| *H01R 13/629* | (2006.01) |
| *H01R 13/635* | (2006.01) |

(52) U.S. Cl.
CPC ..... *H01R 13/514* (2013.01); *H01R 4/245* (2013.01); *H01R 13/518* (2013.01); *H01R 13/6273* (2013.01); *H01R 13/639* (2013.01); *H01R 13/62* (2013.01); *H01R 13/629* (2013.01); *H01R 13/62905* (2013.01); *H01R 13/635* (2013.01)

(58) Field of Classification Search
CPC ..... H01R 13/62; H01R 13/629; H01R 13/62905; H01R 13/639; H01R 13/635
See application file for complete search history.

(56) References Cited

U.S. PATENT DOCUMENTS

| | | | | |
|---|---|---|---|---|
| 5,205,752 A * | 4/1993 | Taguchi | ..... | H01R 13/62905 439/157 |
| 5,569,041 A * | 10/1996 | Sonobe | ..... | H01R 13/639 439/157 |
| 6,231,359 B1 * | 5/2001 | Inaba | ..... | H01R 13/629 439/157 |
| 7,494,352 B2 * | 2/2009 | Furio | ..... | H01R 13/62955 439/157 |

* cited by examiner

*Primary Examiner* — Tho D Ta
(74) *Attorney, Agent, or Firm* — Winston Hsu

(57) ABSTRACT

A modular connector includes a connector body and a locking part. The connector body has a surface. The locking part includes a connection portion and a retaining portion connected to the connection portion. The connection portion is rotatably connected to the surface relative to a direction. The direction is perpendicular to the surface. The locking part is rotatable to engage with a retaining structure of a mating modular connector.

14 Claims, 9 Drawing Sheets

MODULAR CONNECTOR WITH A ROTATABLE LOCKING PART FOR ENGAGING WITH A MATING MODULAR CONNECTOR

BACKGROUND OF THE INVENTION

1. Field of the Invention

The present invention relates to a modular connector, and more particularly to a modular connector having a structure that can prevent another connected modular connector from disengaging.

2. Description of the Prior Art

Connectors are widely used in circumstances requiring connections of electric power or signals. For firm connection, some connectors can be provided with a connecting structure, so that the connecting structures of the connectors that are connected with each other can engage with each other. In some connector designs, the connecting structure thereof is an elastic cantilever, for example a plastic elastic piece of a RJ45 connector that extends outwards. In the process of inserting or extracting the connector, the elastic cantilever needs to elastically deflect up and down relative to the connector body. Repeated elastic deformation will easily induce elastic fatigue, or even cracks in the elastic cantilever. The elastic fatigue will affect the structural elasticity of the elastic cantilever, even to make the connection by the elastic cantilever failed. Furthermore, when the connector is moving, the elastic cantilever also easily hooks other objects and then breaks; for example, the elastic cantilever hooks network cables.

SUMMARY OF THE INVENTION

An objective of the invention is to provide a modular connector, of which a locking part can be rotated to be engaged with a retaining structure of a mating modular connector, so as to achieve a firm connection of the modular connector with the mating modular connector. It is unnecessary for the locking part itself to have an elastic structure.

A modular connector according to the invention is used to be engaged with a mating modular connector. The modular connector includes a connector body and a locking part. The connector body has a surface. The locking part includes a connection portion and a retaining portion connected to the connection portion. The connection portion is rotatably connected to the surface relative to a direction. The direction is perpendicular to the surface. Therein, the locking part is rotatable to engage the retaining portion with a retaining structure of the mating modular connector. Compared with the prior art, the modular connector can provide firm connection with the mating modular connector by rotating the locking part. It is unnecessary for the locking part itself to have an elastic structure. Therefore, the modular connector will not encounter the problem of the elastic fatigue or structural breakage of the elastic cantilever in the prior.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
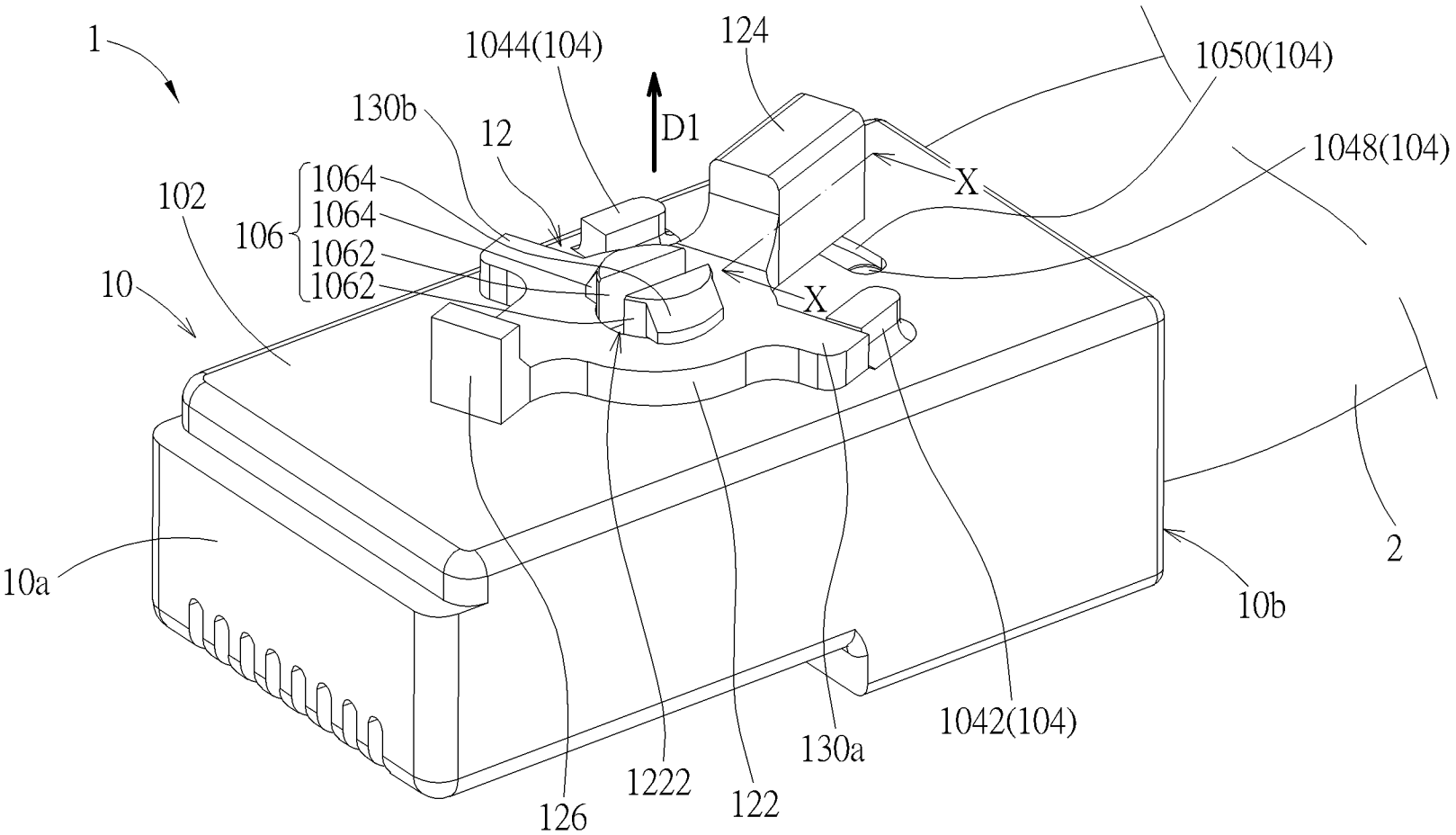
FIG. 1 is a schematic diagram illustrating a modular connector of an embodiment according to the invention.
Figure 2:
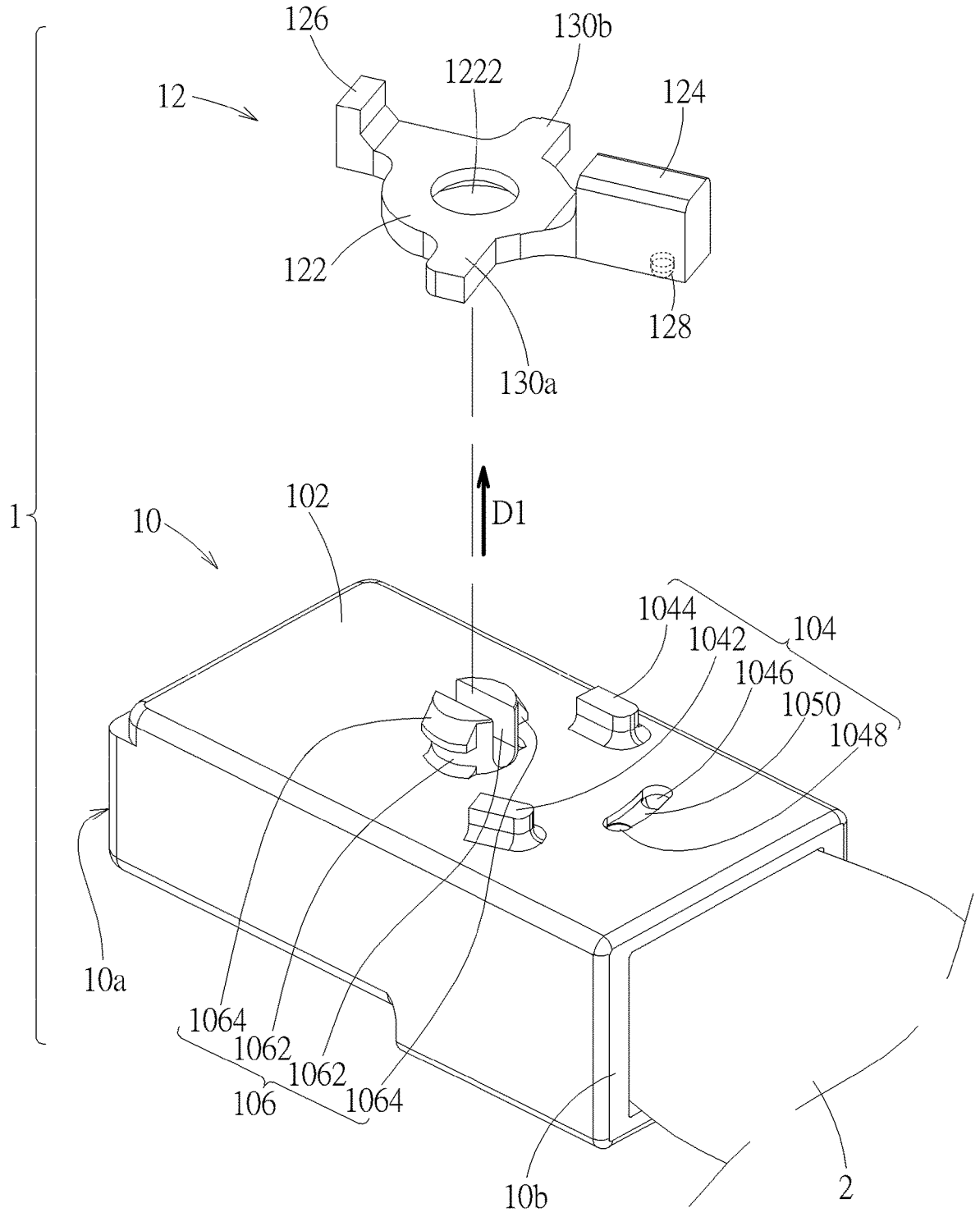
FIG. 2 is a partially exploded view of the modular connector in FIG. 1.

Please refer to FIG. 1 and FIG. 2. A modular connector 1 of an embodiment according to the invention includes a connector body 10 and a locking part 12. The locking part 12 is connected to the connector body 10. The connector body 10 has a connection interface at the lower portion of its front side 10*a*. The locking part 12 includes a connection portion 122, a manipulation portion 124, and a retaining portion 126. The manipulation portion 124 and the retaining portion 126 are respectively connected to the connection portion 122. The connection portion 122 is rotatably connected to a surface 102 of the connector body 10 relative to a direction D1 (indicated by an arrow in FIG. 1). The direction D1 is perpendicular to the surface 102. Thereby, the locking part 12 is rotatable relative to the connector body 10. The manipulation portion 124 is operable to rotate the locking part 12. Furthermore, in the embodiment, the locking part 12 is a single part (for example but not limited to a plastic injection part, a metal pressing part and so on), but it is not limited thereto in practice. For example, the locking part 12 can be a combined part, an insert moulding part and so on. Furthermore, in the embodiment, the manipulation portion 124 and the retaining portion 126 are located at two opposite sides of the connection portion 122, but it is not limited thereto. For example, in an instance, the connection portion is rotatably connected to a place on a surface of the connector body that is close to the rear side of the connector body while the manipulation portion is located between the retaining portion and the connection portion. This structural configuration also can achieve the process of operating the manipulation portion to rotate the locking part so as to change the location of the retaining portion relative to the connector body.

Figure 3:
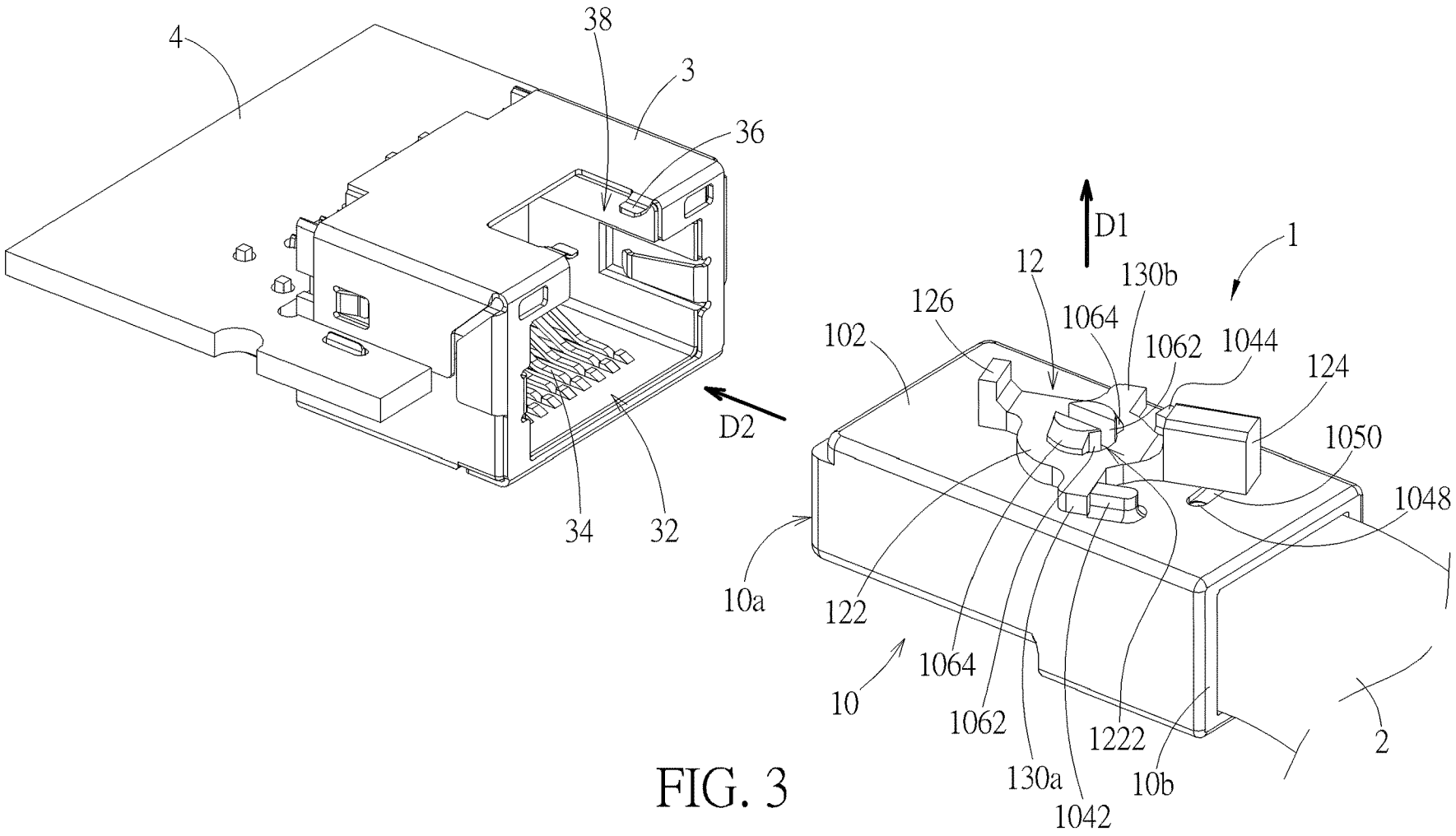
FIG. 3 is a schematic diagram illustrating a connection of the modular connector in FIG. 1 and a mating modular connector.
Figure 4:
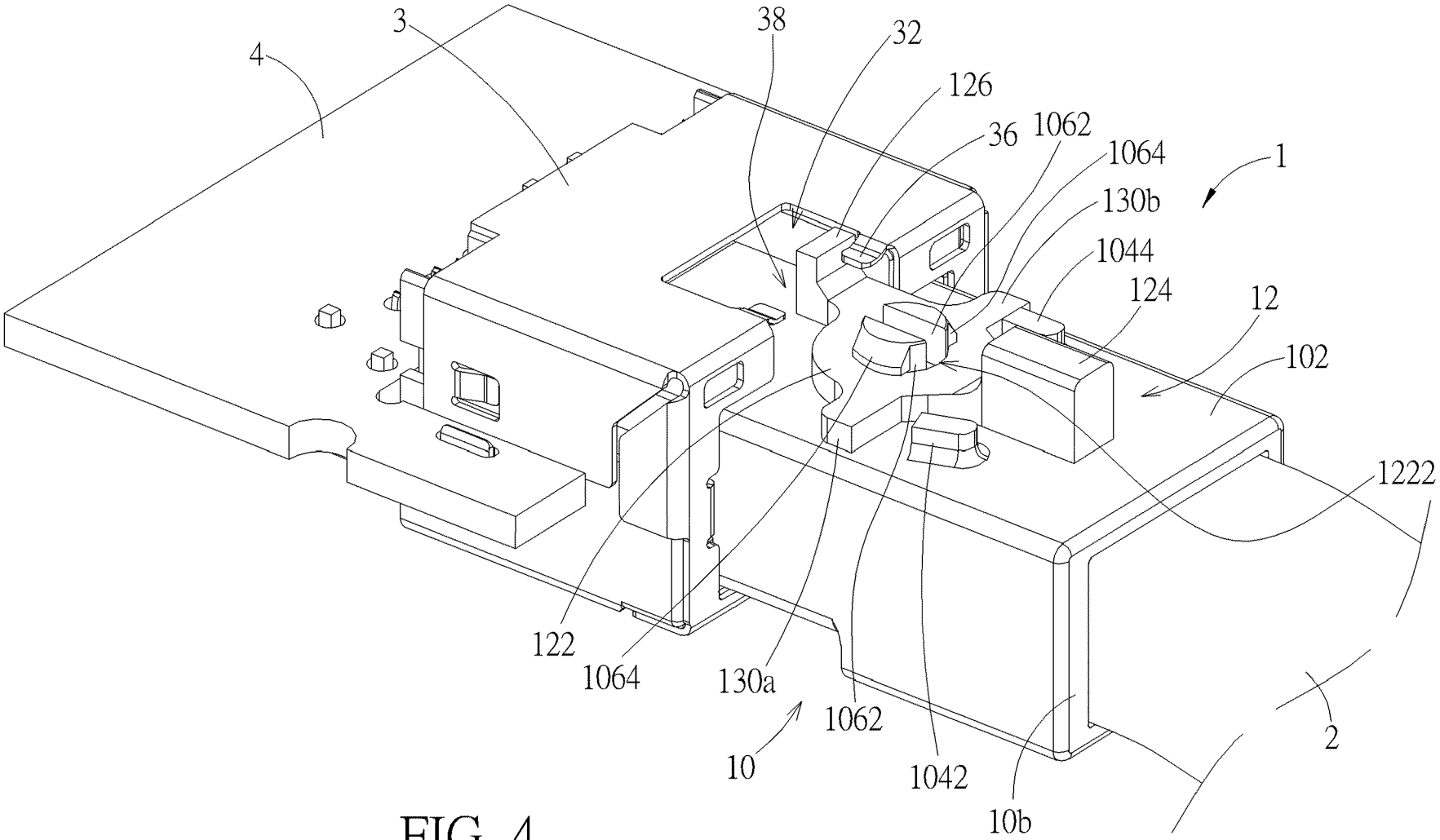
FIG. 4 is a schematic diagram illustrating the modular connector in FIG. 3 that has been inserted into the mating modular connector.

In the embodiment, the modular connector 1 is plug connector and a cable connector as well. A cable 2 is assembled to the modular connector 1 from a rear side 10*b* of the connector body 10 and is connected to the connection interface; for example, the modular connector 1 is a network plug connector. As shown by FIG. 3 and FIG. 4, the modular connector 1 is connected to a mating modular connector 3. The modular connector 3 is a jack connector and a board-end connector as well and is fixed on a circuit board 4; for example, the modular connector 3 is a network jack connector. The modular connector 3 includes an insertion slot 32, a connection interface 34, and a retaining structure 36.

The connection interface 34 is located in the insertion slot 32. The connection of the modular connector 1 and the modular connector 3 can be achieved by inserting the connector body 10 into the insertion slot 32 in an insertion direction D2 (indicated by an arrow in FIG. 3), and rotating the locking part 12 to make the retaining portion 126 engaged with the retaining structure 36. After the modular connector 1 and the modular connector 3 are connected, the connection interface of the modular connector 1 and the connection interface 34 of the modular connector 3 are connected. The engagement of the retaining portion 126 with the retaining structure 36 can prevent the connector body 10 from disengaging from the insertion slot 32, which enhances the stability of the connection of the modular connector 1 and the modular connector 3. When the modular connector 1 is required to be disengaged from the modular connector 3, it is practicable to operate the manipulation portion 124 to rotate the locking part 12 so that the retaining portion 126 is disengaged from the retaining structure 36, and then to extract the connector body 10 from the insertion slot 32 in a direction opposite to the insertion direction D2.

As shown by FIG. 1 and FIG. 2, in the embodiment, the connection portion 122 is pivotally connected to surface 102 through a shaft structure 106. The shaft structure 106 is fixed on the connector body and includes two protruding posts 1062 and an interference structure 1064. The connection portion 122 has a through hole 1222 and is sleeved on protruding posts 1062 of the shaft structure 106 through the through hole 1222. By the interference structure 1064 structurally interfering with the connection portion 122, the shaft structure 106 can avoid or reduce the possibility of the connection portion 122 departing from the shaft structure 106. The interference structure 1064 is realized by two hooks at the ends of the two protruding posts 1062 respectively. The hooks hook the through hole 1222 for preventing the connection portion 122 from departing from the protruding post 1062; however, it is not limited thereto in practice. For example, the interference structure 1064 can be realized by a structure that protrudes sideward from the protruding post 1062 (i.e. protruding perpendicular to the direction D1) and also can structurally interfere with the through hole 1222. Furthermore, in practice, the interference structure 1064 can be disposed one of the protruding posts 1062, which also can prevent the connection portion 122 from departing from the protruding post 1062. In addition, in practice, the connection portion 122 also can be pivotally connected to the connector body 10 in other ways. For example, in an instance, the connection portion has a protruding shaft while the connector body has a shaft hole. The pivotal connection of the connection portion and the connector body can be achieved by inserting the protruding shaft into the shaft hole. In another instance, the shaft structure is realized by a shaft. The connection portion is sleeved on the shaft through the through hole. Then, a retaining ring (such as a C-clip) is installed onto the shaft so as to prevent the connection portion from departing from the shaft.

Figure 5:
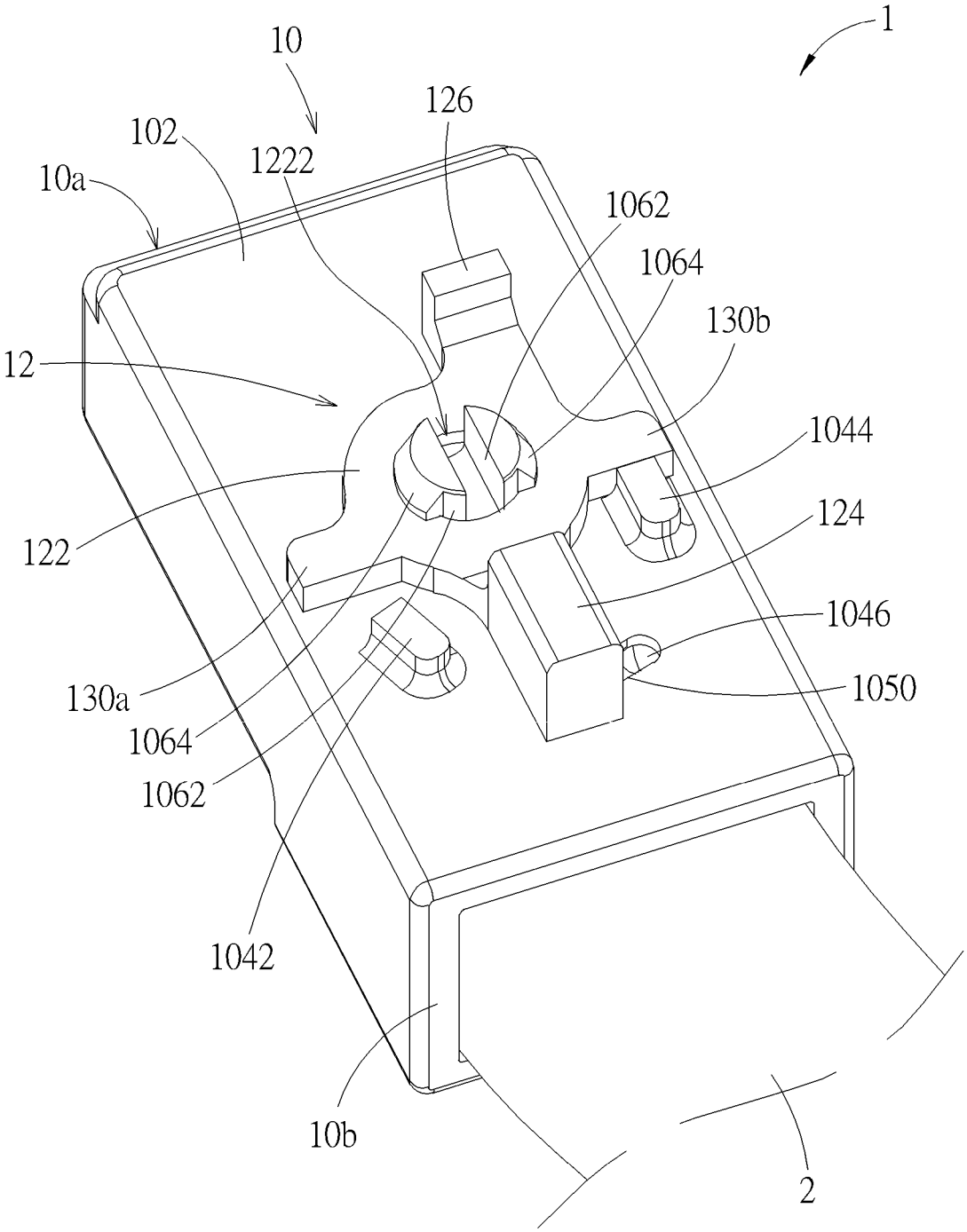
FIG. 5 is a schematic diagram illustrating the modular connector in FIG. 1, of which a locking part is located at a retaining position.

As shown by FIG. 2, the connector body 10 includes a positioning structure 104. The positioning structure 104 structurally interferes with the locking part 12 to position the locking part 12 at least one position, for convenience of inserting or extracting the connector body 10. In the embodiment, the positioning structure 104 includes a first blocking structure 1042, a second blocking structure 1044, a first engaging structure 1046, and a second engaging structure 1048. The locking part 12 includes a third engaging structure 128 (of which the hidden profile sections are shown in dashed lines in FIG. 2). As shown by FIG. 1 (or FIG. 3), the locking part 12 abuts against the first blocking structure 1042 while the locking part 12 is positioned at a disengaging position; at the moment, the third engaging structure 128 is engaged with the first engaging structure 1046. As shown by FIG. 5 (or FIG. 4), the locking part 12 abuts against the second blocking structure 1044 while the locking part 12 is positioned at a retaining position; at the moment, the third engaging structure 128 is engaged with the second engaging structure 1048. Thereby, after a user rotates the locking part 12, the locking part 12 can be positioned by the structural interference of the positioning structure 104 with the locking part 12. Before inserting the modular connector 1 into the modular connector 3, the user can rotate the locking part 12 to make the locking part 12 positioned at the disengaging position (as shown by FIG. 1). During the process of inserting the modular connector 1 into the modular connector 3, the retaining portion 126 will not structurally interfere with the modular connector 3. After inserting the connector body 10 into the insertion slot 32, the user can rotate the locking part 12 to make the locking part 12 positioned at the retaining position, so that the retaining portion 126 is engaged with the retaining structure 36 so as to achieve the connection of the modular connector 1 and the modular connector (as shown by FIG. 4).

In the embodiment, the first blocking structure 1042 and the second blocking structure 1044 are respectively realized by a protruding structure that protrudes from the surface 102 of the connector body 10. The locking part 12 includes two protruding portions 130*a* and 130*b* that protrude outwards from the connection portion 122 (i.e. protruding perpendicular to the direction D1). The locking part 12 can abut against the first blocking structure 1042 through the protruding portion 130*a*, so that the locking part 12 is positioned at the disengaging position (as shown by FIG. 1); the locking part 12 can abut against the second blocking structure 1044 through the protruding portion 130*b*, so that the locking part 12 is positioned at the retaining position (as shown by FIG. 4 or FIG. 5). In practice, the structural limitation of the first blocking structure 1042 and the second blocking structure 1044 to the locking part 12 also can be achieved by other ways. For example, in an instance, the location of the first blocking structure and the second blocking structure is designed properly, so that the manipulation portion abuts against the first blocking structure when the locking part is located at the disengaging position, and the manipulation portion abuts against the second blocking structure when the locking part is located at the retaining position. In this instance, the protruding portions can be skipped. In another instance, a recess is formed at an edge of the connection portion. One of the first blocking structure and the second blocking structure (e.g. the first blocking structure) is disposed in the recess correspondingly, so that when the locking part rotates, the first blocking structure relatively slides in the recess. When the first blocking structure abuts against an end of the recess, the locking part can be defined to be located at the disengaging position; when the first blocking structure abuts against the other end of the recess, the locking part can be defined to be located at the retaining position. In this instance, the second blocking structure can be skipped. Furthermore, it is practicable to form the recess inside the connection portion so as to forma sliding slot. This structural configuration also can achieve the above positioning effect.

Figure 6:
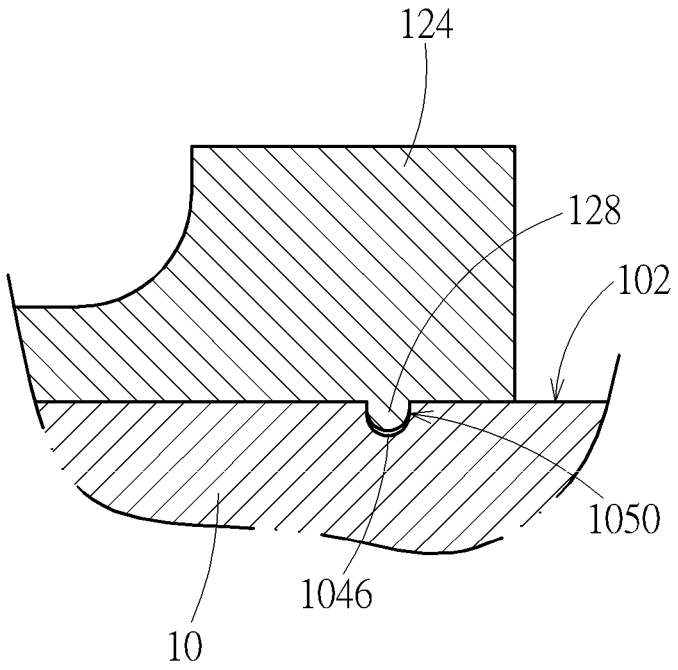
FIG. 6 is a sectional view of part of the modular connector along the line X-X in FIG. 1.

In the embodiment, the first engaging structure 1046 and the second engaging structure 1048 are respectively realized by a depression disposed on the surface 102 of the connector body 10. The third engaging structure 128 is realized by a protrusion. The protrusion fits in the first engaging structure 1046 (as shown by FIG. 1 or FIG. 6) while the locking part 12 is located at the disengaging position; the protrusion fits in the second engaging structure 1048 (as shown by FIG. 4 or FIG. 5) while the locking part 12 is located at the retaining position. In practice, it is practicable as long as the structures of the first engaging structure 1046 and the second engaging structure 1048 can fit with the third engaging structure 128, which also can produce a positioning effect in a certain degree. In the embodiment, the protrusion and the depression respectively show a hemisphere. As shown by FIG. 6, in the state that the third engaging structure 128 and the second engaging structure 1048 are engaged, the protrusion partially extends into the depression to achieve the above-mentioned engagement. In practice, if the protrusion and the depression substantially closely fit, this engagement can provide a more stable positioning effect.

Furthermore, in the embodiment, the protrusion (i.e. the third engaging structure 128) is immobile, but it is not limited thereto. For example, the third engaging structure 128 is realized by a ball plunger embedded in the manipulation portion 124. In addition, in another embodiment, the first engaging structure 1046 and the second engaging structure 1048 can respectively be realized by a protrusion instead, and correspondingly, the third engaging structure 128 can be realized by a depression instead. This structural configuration also can achieve the above-mentioned positioning effect.

Furthermore, in practice, it is practicable as long as the third engaging structure 128 can be engaged with the first engaging structure 1046 and the second engaging structure 1048. The third engaging structure 128 can be disposed on any location of the locking part 12 in principle. In the embodiment, the third engaging structure 128 is disposed on the portion of the manipulation portion 124 that is relatively away from the rotation center of the connection portion 12, so that the structural constraint force by the engagement of the protrusion with the depression can produce a larger moment of force to the locking part 12 for resisting the rotation of the locking part 12, which is conducive to enhancement the positioning effect of the first engaging structure 1046 (or the second engaging structure 1048) to the third engaging structure 128.

In the embodiment, the positioning structure 104 further includes a curved guiding slot 1050, formed on the surface 102 of the connector body 10. The first engaging structure 1046 and the second engaging structure 1048 are located at two ends of the curved guiding slot 1050 respectively. When the locking part 12 rotates, the third engaging structure 128 slides in the curved guiding slot 1050. In the embodiment, the sectional profile of the curved guiding slot 1050 in its extending direction shows a semi-circle, of which the radius is substantially equal to the radius of the hemisphere of the protrusion (i.e. the third engaging structure 12). Therefore, when the locking part 12 rotates, the curved guiding slot 1050 also can produce structural constraint to the protrusion, which can enhance the stability of the rotation of the locking part 12. In addition, in the embodiment, the blocking structures 1042 and 1044 and the engaging structures 1046 and 1048 of the positioning structure 104 all can produce the positioning effect to the locking part 12. In practice, it is practicable to selectively use one of the blocking structures 1042 and 1044 and the engaging structures 1046 and 1048, which will not be described in addition. Furthermore, in practice, the positioning structure 104 can be realized by a structure that can produce frictional force. For example, the through hole 1222 of the connection portion 122 with the shaft structure 106 are engaged in accordance with an interference fit, so that the frictional force produced by both is sufficient to fix the locking part 12 relative to the connector body 10 without external force for rotating the connector body 10, so as to produce positioning effect.

Figure 7:
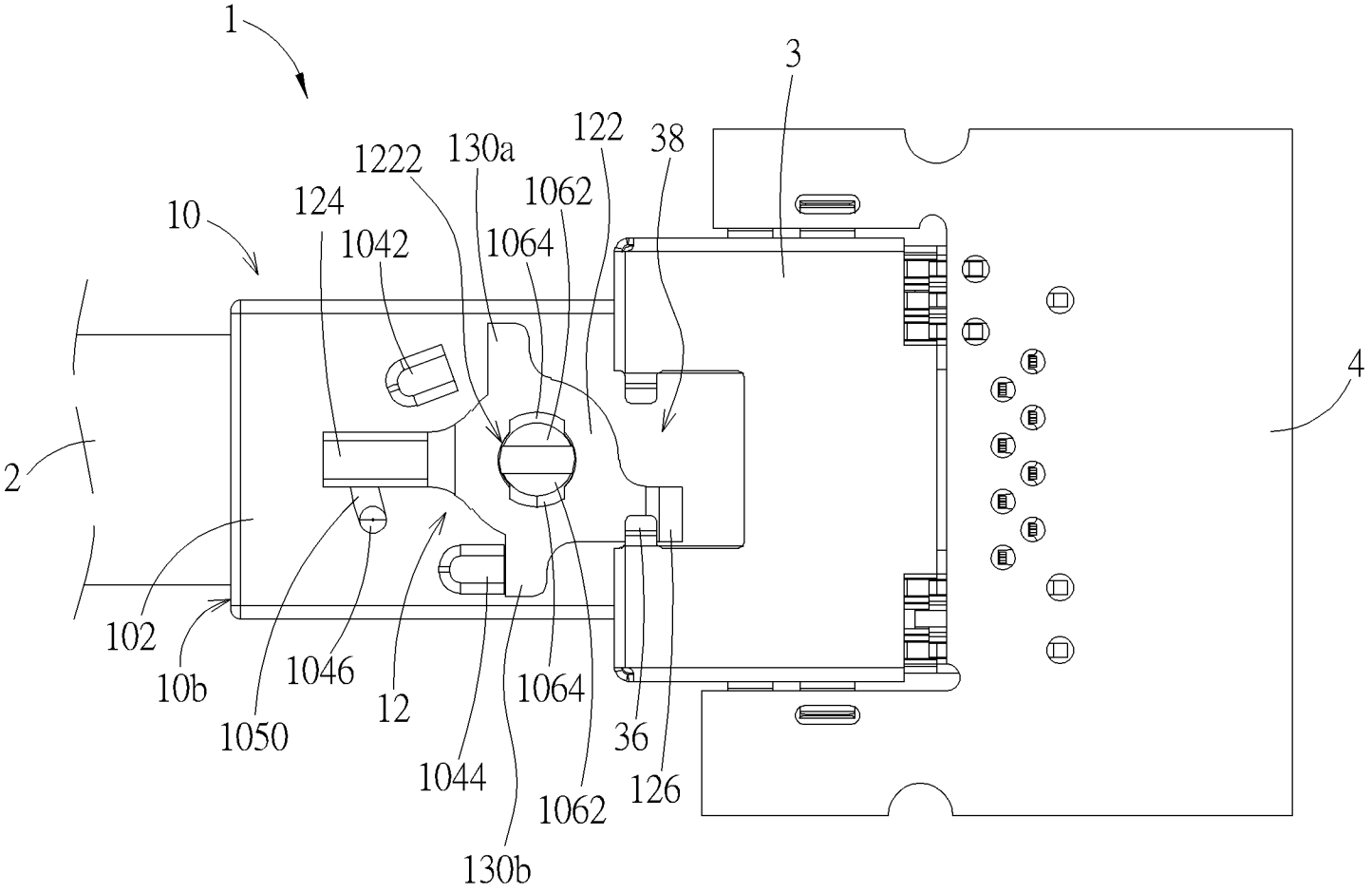
FIG. 7 is a top view of the modular connector in FIG. 4, of which a retaining portion is engaged with a retaining structure of the mating modular connector.

In the embodiment, as shown by FIG. 3, an end of the retaining portion 126 extends upward parallel to the direction D1 to form an L-shaped structure. The modular connector 3 has an avoidance passageway 38 connecting to the insertion slot 32. The retaining structure 36 is located at a side of the opening of the insertion slot 32. During the process of inserting the connector body 10 into the insertion slot 32, the retaining portion 126 (or its end) can pass through the avoidance passageway 38 to enter the modular connector 3. Then, the user can rotate the locking part 12 to make the retaining portion 126 hook the retaining structure 36, as shown by FIG. 7. In practice, the structure of the retaining portion 126 depends on the engaging mechanism thereof with the retaining structure 36, and is not limited to the embodiment.

Figure 8:
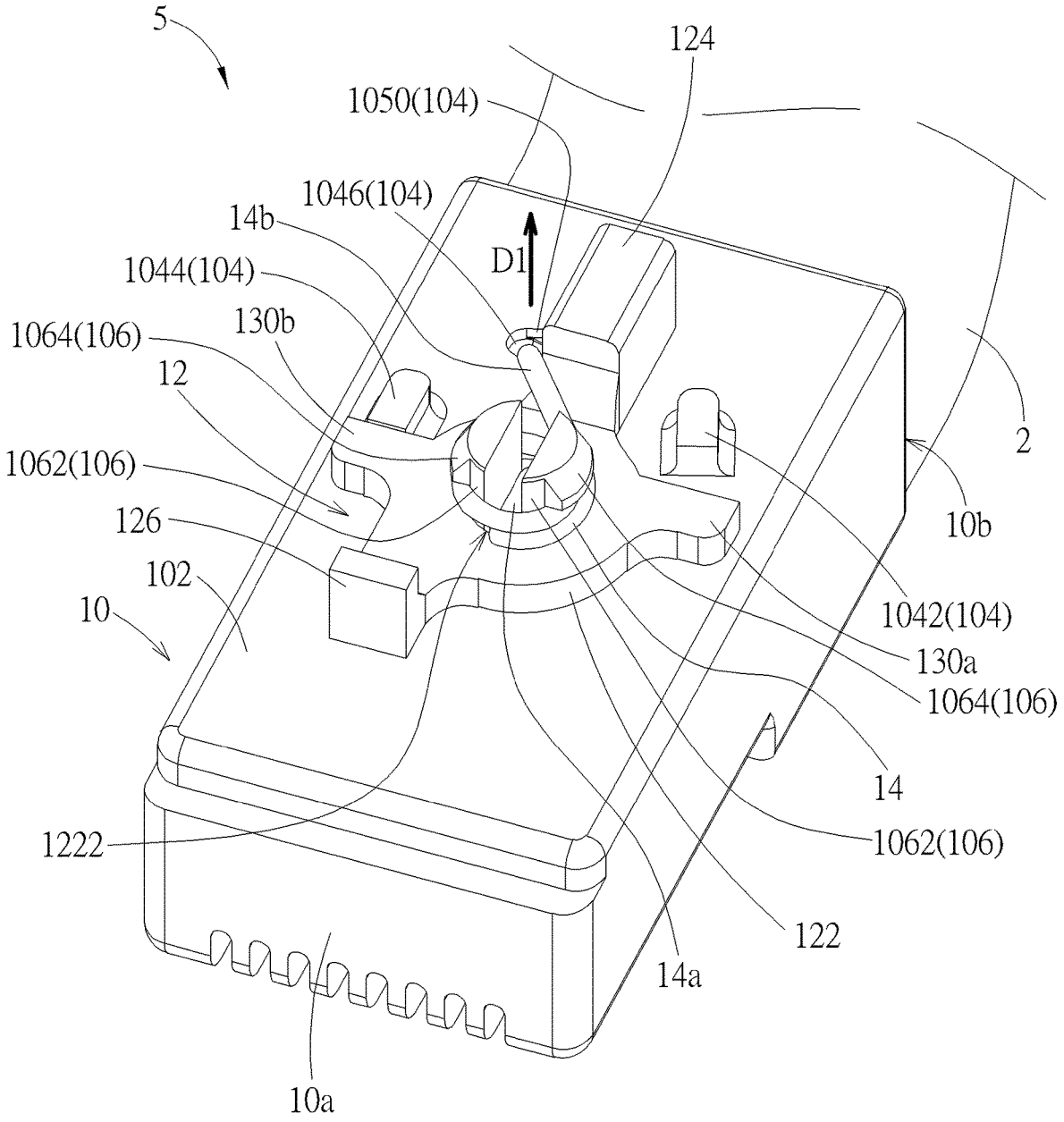
FIG. 8 is a schematic diagram illustrating a modular connector according to an embodiment.

As described above, the positioning of the locking part 12 relative to the connector body 10 needs rotating the locking part 12 by the user; however, it is not limited thereto in practice. For example, as shown by FIG. 8, a modular connector 5 according to another embodiment is structurally similar to the modular connector 1, so the modular connector 5 uses the reference numbers used in the modular connector 1 in principle. For other descriptions about the modular connector 5, please refer to the relevant descriptions of the modular connector 1 and variants thereof, which will not be described in addition. Compared with the modular connector 1, the modular connector 5 further includes a restoration spring 14 that is connected to the locking part 12 and the shaft structure 106 for providing the locking part 12 a restoration force. In the embodiment, the restoration spring 14 is a torsion spring. One end 14*a* of the torsion spring is connected to the shaft structure 106 (e.g. held between the two protruding posts 1062), and the other end 14*b* of the torsion spring is connected to the manipulation portion 124 (e.g. abutting against a side of the manipulation portion 124), so that the restoration spring 14 can provide the locking part 12 a driving force to rotate toward the retaining position. The restoration spring 14 is conducive to the stability of the engagement of the retaining portion 126 with the retaining structure 36. Therein, the body of the torsion spring is held between the interference structure 1064 and the connection portion 122; however, it is not limited thereto in practice. For example, in an instance, the body of the torsion spring is placed on the connection portion 122, and the interference structure 1064 is entirely located at the inside of the body of the torsion spring. Furthermore, in practice, the end 14*b* of the torsion spring also can be connected to other portions of the locking part 12, e.g. fixed on the connection portion 122, of which the specific implementation details can be achieved by referring to the restoration spring 14 in FIG. 8 and the relevant descriptions, and will not be described in addition.

Figure 9:
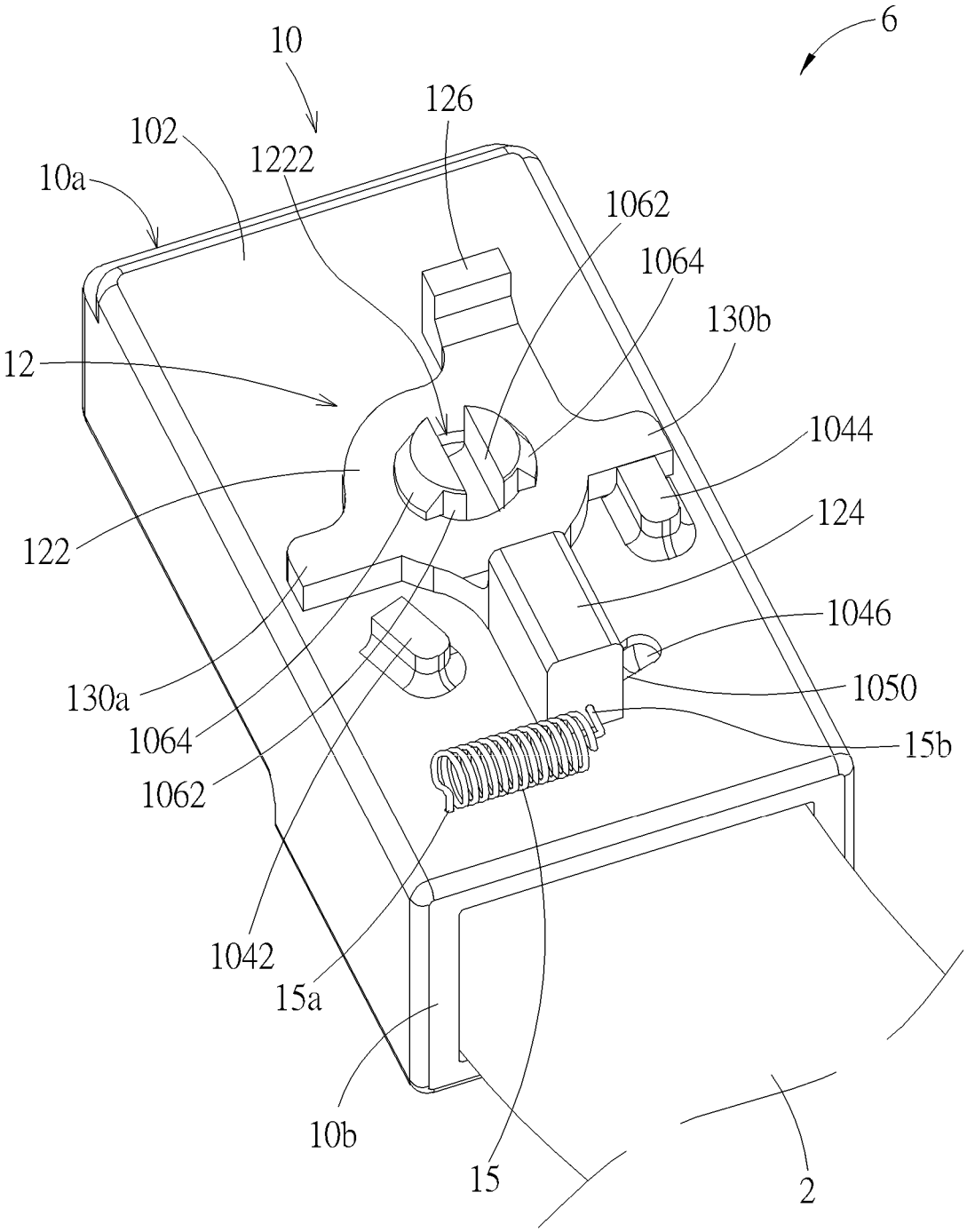
FIG. 9 is a schematic diagram illustrating a modular connector according to an embodiment.

For another example, as shown by FIG. 9, a modular connector 6 according to another embodiment is structurally similar to the modular connector 1, so the modular connector 6 uses the reference numbers used in the modular connector 1 in principle. For other descriptions about the modular connector 6, please refer to the relevant descriptions of the modular connector 1 and variants thereof, which will not be described in addition. Compared with the modular connector 1, the modular connector 6 further includes a restoration spring 15 that is connected to the locking part 12 and the connector body 10 for providing the locking part 12 a restoration force. In the embodiment, the restoration spring 15 is a tension spring. One end 15*a* of the tension spring is connected to the connector body 10 (e.g. inserting into a hole of the connector body 10), and the other end 15*b* of the tension spring is connected to the manipulation portion 124 (e.g. inserting into a hole of the manipulation portion 124), so that the locking part 12 has a tendency to rotate toward the retaining position. Furthermore, in practice, the end 14*b* of the tension spring also can be connected to other portions of the locking part 12, e.g. the connection portion 122 or the retaining portion 126, of which the specific implementation details can be achieved by referring to the restoration spring 15 in FIG. 9 and the relevant descriptions, and will not be described in addition. Furthermore, in practice, the restoration spring 15 can be realized by a compression spring instead. In this case, the location of the compression spring is opposite to the location of the restoration spring 15 in FIG. 9. For example, in the viewpoint of FIG. 9, the tension spring is located at the left side of the manipulation portion 124 while the compression spring is located at the right side of the manipulation portion 124.

As described above, the modular connectors 1, 5 and 6 can be firmly connected with the modular connector 3 by rotating the locking part 12. It is unnecessary for the locking part 12 itself to have an elastic structure. Furthermore, in the modular connectors 1, 5 and 6, the rotation axis of the locking part 12 is perpendicular to the surface 102, so the locking part 12 is rotatable substantially parallel to the surface 102 in principle (e.g. when the surface 102 is a plane). Even if the locking part 12 (or the retaining portion 126 thereof) unexpectedly hooks external cables or structures during the process of uninstalling or installing the modular connectors 1, 5 and 6, the external cables or structures hardly structurally damage the locking part 12 and it is easy to separate the external cables or structures from the locking part 12. Therefore, the locking part 12 unexpectedly hooking external cables or structures will not essentially affect the locking part 12 in principle. Furthermore, in the above embodiments, the retaining structure 36 is located inside the modular connector 3. However, in practice, the disposition of the retaining structure 36 depends on the design of the connection structure of the modular connector 3 with the modular connectors 1, 5 and 6. Hence, in some different design of the connection structure, the retaining structure 36 may be located at an outside surface of the modular connector 3, and the design of the locking part 12 of the modular connector 1 is also based on the same design of the connection structure so as to be able to engage with the retaining structure 36, which will not be described in addition. In addition, in the above embodiment, the modular connectors 1, 5 and 6 are illustrated with plug connectors, cable connectors, and the modular connector 3 is illustrated with a jack connector, board-end connector; however, it is not limited thereto. In practice, the modular connector according to the invention is practicable to jack connectors, board-end connectors, and other types of connectors (e.g. combination connectors that includes a plug portion and a jack portion and can be cable connectors or board-end connectors), of which the specific implementation details can be achieved by referring to the above descriptions, and will not be described in addition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A modular connector, used to be engaged with a mating modular connector, the modular connector comprising:

a connector body, having a surface; and a locking part, comprising a connection portion and a retaining portion connected to the connection portion, the connection portion being rotatably connected to the surface through a shaft structure relative to a direction, the direction being perpendicular to the surface, the shaft structure being fixed on the connector body and comprising an interference structure, the connection portion having a through hole and being sleeved on the shaft structure through the through hole, the shaft structure structurally interfering with the connection portion through the interference structure;

wherein the locking part is rotatable to engage the retaining portion with a retaining structure of the mating modular connector.

2. The modular connector according to claim 1, further comprising a restoration spring, connected to the locking part and the shaft structure.

3. The modular connector according to claim 1, wherein an end of the retaining portion extends upward parallel to the direction to form an L-shaped structure.

4. The modular connector according to claim 1, further comprising a restoration spring, connected to locking part and the connector body.

5. The modular connector according to claim 1, wherein the connector body comprises a positioning structure, and the positioning structure structurally interferes with the locking part to position the locking part at least one position.

6. The modular connector according to claim 5, wherein the positioning structure comprises a first blocking structure, and the locking part abuts against the first blocking structure while the locking part is located at a disengaging position and the retaining portion is disengaged from the retaining structure of the mating modular connector.

7. The modular connector according to claim 6, wherein the first blocking structure is a protruding block, the locking part comprises a protruding portion, and the locking part abuts against the first blocking structure through the protruding portion.

8. The modular connector according to claim 6, wherein the positioning structure comprises a second blocking structure, and the locking part abuts against the second blocking structure while the locking part is located at a retaining position and the retaining portion is engaged with the retaining structure of the mating modular connector.

9. The modular connector according to claim 5, wherein the positioning structure comprises a first engaging structure, the locking part comprises a third engaging structure, and the third engaging structure is engaged with the first engaging structure while the locking part is located at a disengaging position and the retaining portion is disengaged from the retaining structure of the mating modular connector.

10. The modular connector according to claim 9, wherein the first engaging structure is a depression or a protrusion, and the third engaging structure is a protrusion or a depression correspondingly.

11. The modular connector according to claim 9, wherein the locking part comprises a manipulation portion connected to the connection portion, the manipulation portion is operable to rotate the locking part, and the third engaging structure is disposed on the manipulation portion.

12. The modular connector according to claim 9, wherein the positioning structure comprises a second engaging structure, and the third engaging structure is engaged with the second engaging structure while the locking part is located at a retaining position and the retaining portion is engaged with the retaining structure of the mating modular connector.

13. The modular connector according to claim 12, wherein each of the first engaging structure and the second engaging structure is a depression, the positioning structure comprises a curved guiding slot, the first engaging structure and the second engaging structure are located at two ends of the curved guiding slot respectively, and the third engaging structure is a protrusion and is slidably disposed in the curved guiding slot.

14. The modular connector according to claim 13, wherein the positioning structure comprises a first blocking structure and a second blocking structure, the locking part abuts against the first blocking structure while the locking part is located at the disengaging position, and the locking part abuts against the second blocking structure while the locking part is located at the retaining position and the retaining portion is engaged with the retaining structure of the mating modular connector.

* * * * *